United States Patent [19]

Ciampi

[11] Patent Number: 5,058,338

[45] Date of Patent: Oct. 22, 1991

[54] ENERGY DISSIPATING DEVICE FOR RENDERING A STRUCTURE IMPERVIOUS TO SEISMIC OCCURRENCES

[75] Inventor: Vincenzo Ciampi, Roma, Italy

[73] Assignee: FIMA S.p.A., Milan, Italy

[21] Appl. No.: 498,745

[22] Filed: Mar. 26, 1990

[30] Foreign Application Priority Data

Apr. 11, 1989 [IT] Italy ..... 20102 A/89

[51] Int. Cl.[5] ..... E02D 27/34; E04H 9/02

[52] U.S. Cl. ..... 52/167 DF; 52/167 R; 248/636; 248/638

[58] Field of Search ..... 52/167 R, 167 CB, 167 DF; 248/569, 636, 638

[56] References Cited

U.S. PATENT DOCUMENTS

| | | | |
|---|---|---|---|
| 3,638,377 | 2/1972 | Caspe | 52/167 R |
| 3,690,607 | 9/1972 | Mard | 248/638 X |
| 3,973,078 | 3/1976 | Wolf et al. | 52/167 R X |
| 4,328,648 | 5/1982 | Kalpins | 52/167 R |
| 4,353,189 | 10/1982 | Thiersch et al. | 52/167 R |
| 4,458,861 | 7/1984 | Mouille | 248/638 X |
| 4,917,211 | 4/1990 | Yamada et al. | 52/167 R |

FOREIGN PATENT DOCUMENTS

| | | | |
|---|---|---|---|
| 665074 | 5/1979 | U.S.S.R. | 52/167 R |
| 735723 | 5/1980 | U.S.S.R. | 52/167 DF |
| 1325161 | 7/1987 | U.S.S.R. | 52/167 R |
| 1420267 | 8/1988 | U.S.S.R. | 248/636 |

*Primary Examiner*—David A. Scherbel
*Assistant Examiner*—Deborah McGann Ripley
*Attorney, Agent, or Firm*—Wenderoth, Lind & Ponack

[57] ABSTRACT

An energy dissipating device, particularly for use in structures impervious to seismic occurrences, includes a metal element having the shape of at least a symmetrical double portal, which is asymmetrically deformable in the elastic field or beyond the elastic limit. The center pier of this portal is fastened to one portion of the structure, whereas the two side piers are fastened to another portion of the structure so as to compel this metal element, upon a relative movement of the two portions of the structure, to be deformed in the elasto-plastic field, thereby dissipating the deformation work by hysteresis of the material principally in the form of heat.

4 Claims, 3 Drawing Sheets

FIG.3A
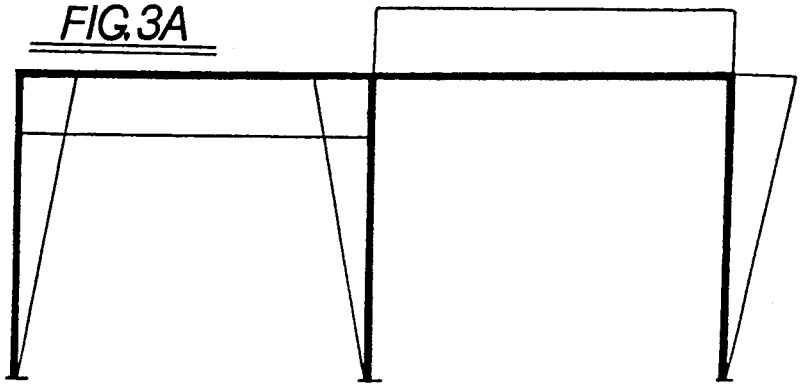
FIG.3B
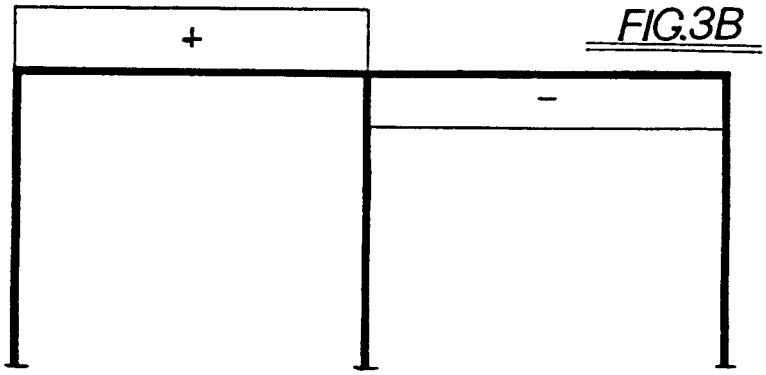
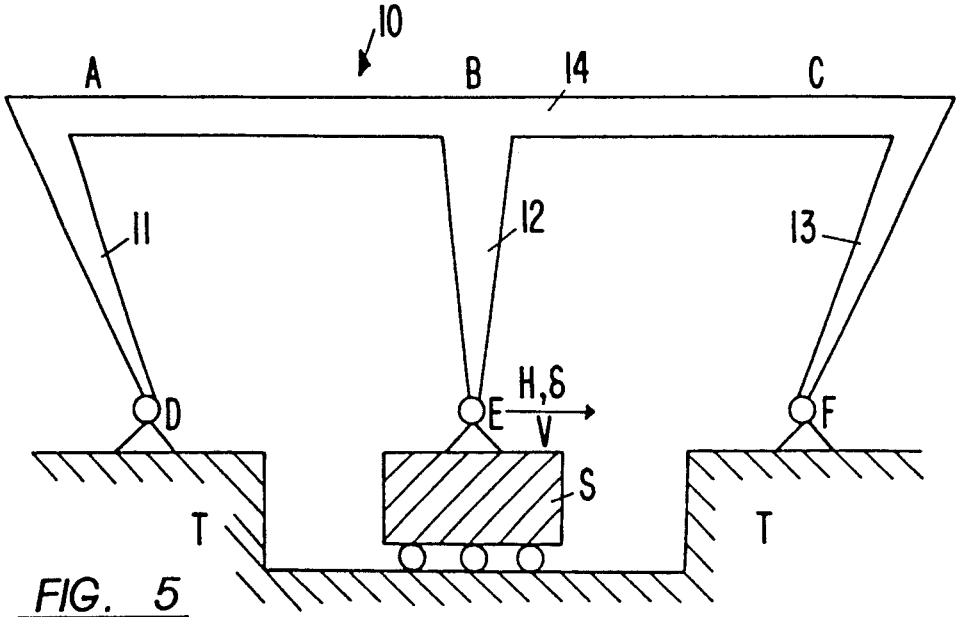
FIG. 5

ENERGY DISSIPATING DEVICE FOR RENDERING A STRUCTURE IMPERVIOUS TO SEISMIC OCCURRENCES

BACKGROUND OF THE INVENTION

1. Field of the Invention

The present invention relates to energy dissipating devices which are employed particularly, but not exclusively, in structures impervious to seismic occurrences and more particularly to an energy dissipating device having higher functional and structural features than those of the energy dissipating devices which are presently used.

2. Description of the Prior Art

As known, a structure which is to be impervious to a seismic occurrence must exhibit a high capacity of dissipating energy in the post-elastic field. This capacity of dissipating energy can be particularly assigned to special dissipative devices arranged in suitable locations of the structure. Because such devices dissipate the energy supplied to the structure by a violent earthquake in a controlled manner and according to predetermined forms, they can assure a good seismic protection of the structure by preventing the collapse thereof and by containing the damage to the structure.

As a matter of fact, the main object of these devices is to reduce the response of the whole structural system in the case of very violent earthquakes by suitably controlling the very high stresses transmitted to the supporting structures until an "integral seismic protection" of all the elements forming the primary resistive system has been possibly attained.

The most recent energy dissipating devices employed for this purpose to take advantage of the elasto-plastic behavior of structural metal elements, which are subjected to flexural, normal and torsional stresses, or a combination thereof, are usually affected by the following disadvantages:

the load-deformation diagram beyond the elastic limit is not constant, but variable because a metal element changes its geometry, with resulting increase or decrease of the stiffness; and the plastic deformations tend to localize in some restricted areas, thereby causing the premature failure of the metal elements after a few cycles of alternating stress.

SUMMARY OF THE INVENTION

The object of the present invention is to obviate these disadvantages.

More particularly, the energy dissipating device to be used in structures subjected to earthquakes according to the present invention comprises a metal element having the shape of at least a symmetrical double portal which is asymmetrically deformable in the elastic field or beyond the elastic limit, the center pier of which is fastened to one portion of the structure, whereas the two side piers are fastened to another portion of the structure so as to compel said metal element, in the case of a relative movement of said two portions of the structure, to be deformed in the elasto-plastic field, thereby dissipating the deformation work by hysteresis of the material, principally in the form of heat.

BRIEF DESCRIPTION OF THE DRAWINGS

FIG. 3A is a diagram of the distribution of the bending moment stresses;

FIG. 3B is a diagram of the normal stress distribution in the energy dissipating device in the condition of asymmetrical stress caused by a relative movement 5;

FIG. 5 is a diagrammatic view of the energy dissipating device in the form of a double portal with inclined side piers according to the present invention.

DETAILED DESCRIPTION OF THE PREFERRED EMBODIMENTS

Figure 1:
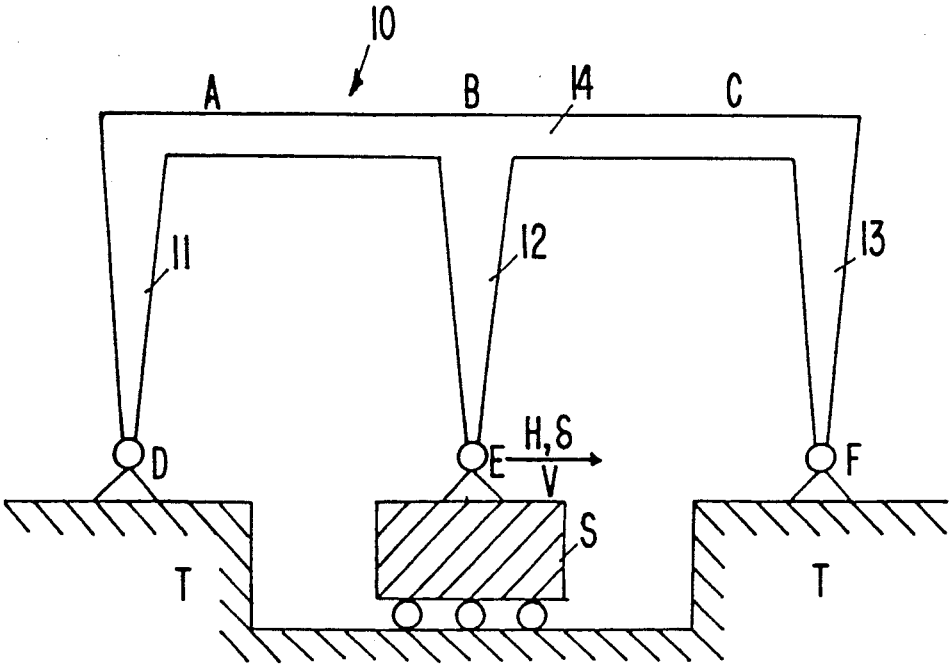
FIG. 1 is a diagrammatic view of the energy dissipating device in the form of a double portal according to the present invention.

As can be seen from the drawings, the energy dissipating device having an elasto-plastic behavior according to the present invention substantially comprises a metal portal, generally designated by reference numeral 10. The portal is formed by a girder 14 supported by three piers 11, 12 and 13. Each of the piers is arranged along a vertical axis and the piers are rigidly connected to the ends of the girder at points A and C and to the center of the girder at point B. The center pier 12 is intended to be fastened, through a hinge arranged at the free end E thereof, to one portion of the structure, generally designated by S. This portion S of the structure can move in the direction indicated by the arrow V representing the direction of the force H and the shift $\delta$, whereas the two side piers 11 and 13 are intended to be fastened, again through a hinge arranged at the free ends D and F thereof, to another portion of the structure, generally designated by T.

The metal employed in the manufacturing of this energy dissipating device in the form of a double portal is a steel having high ductility, that is capable of supporting several cycles of plastic deformation without failure.

The operation of the energy dissipating device is as follows.

By applying to the free end E of the center pier 12 a force H directed along the arrow V, the portal segments AB and BC, which are the portions which deform in the elasto-plastic field, are subjected to bending moments and normal stresses which are constant for all the length of the segments AB and BC respectively, but of opposite sign (see FIG. 3A for the bending moments and FIG. 3B for the normal stresses); in this manner, two advantages are obtained:

the flexural deformations of the segments AB and BC are not localized, but evenly distributed along all of the segments; this permits a high energy dissipation to be obtained, by avoiding the localization of the plastic deformation which could cause premature failures;

because of the asymmetry of the stress condition, particularly with reference to the presence of normal stresses which in one portion of the girder are tensile stresses and in the other portion of the girder are compressive stresses, the second order effects which would cause the stiffness to be changed as the deformation increases are compensated for in such a manner that the load-deformation diagram beyond the elastic limit practically becomes constant.

Figure 2:
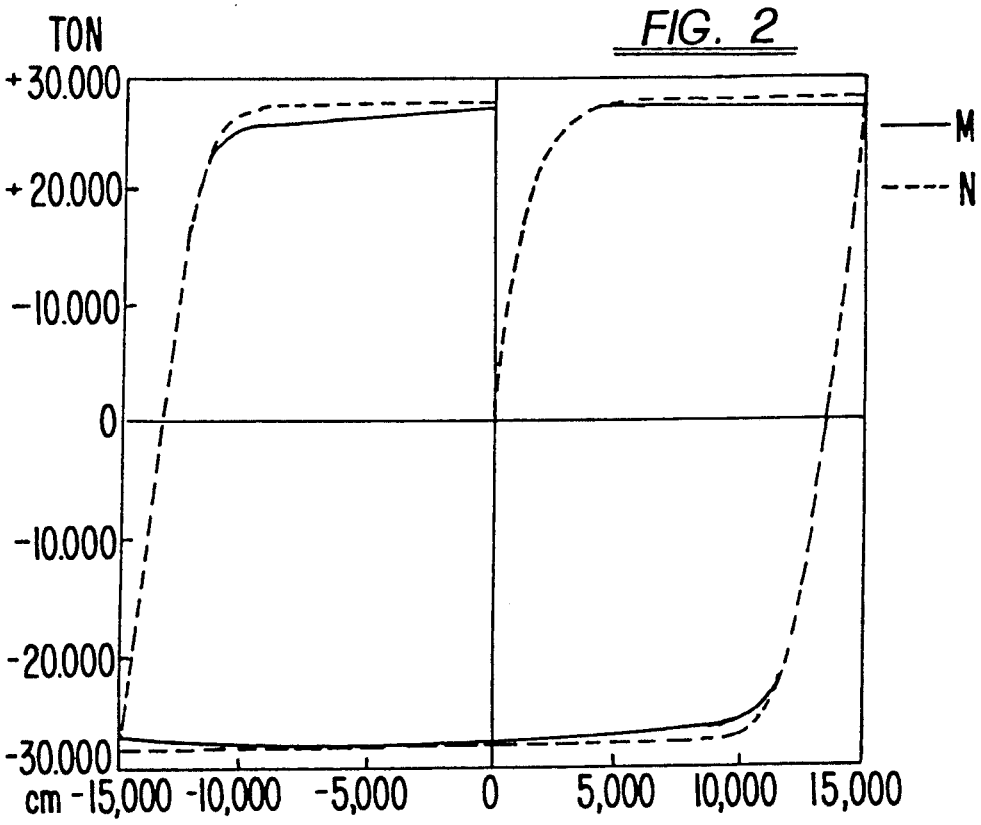
FIG. 2 is a load-deformation diagram of the device of FIG. 1.

As can be seen from FIG. 2, which shows the load-deformation diagram of the energy dissipating device, obtained by numerical simulation, the dotted line N and the full line M which relate to the case in which the second order effects are taken into account or the case in which the second order effects are not taken into account, respectively, are very close to each other; they show also that the energy dissipated by this device, which is represented by the area of the hysteresis loop, is very high. As a matter of fact, the "dissipative efficiency" of a loop can be defined as the ratio of the area of the effective loop (dissipated energy) to the area of the ideal rectangle defined by the extreme values of the force and the movement.

Figure 4:
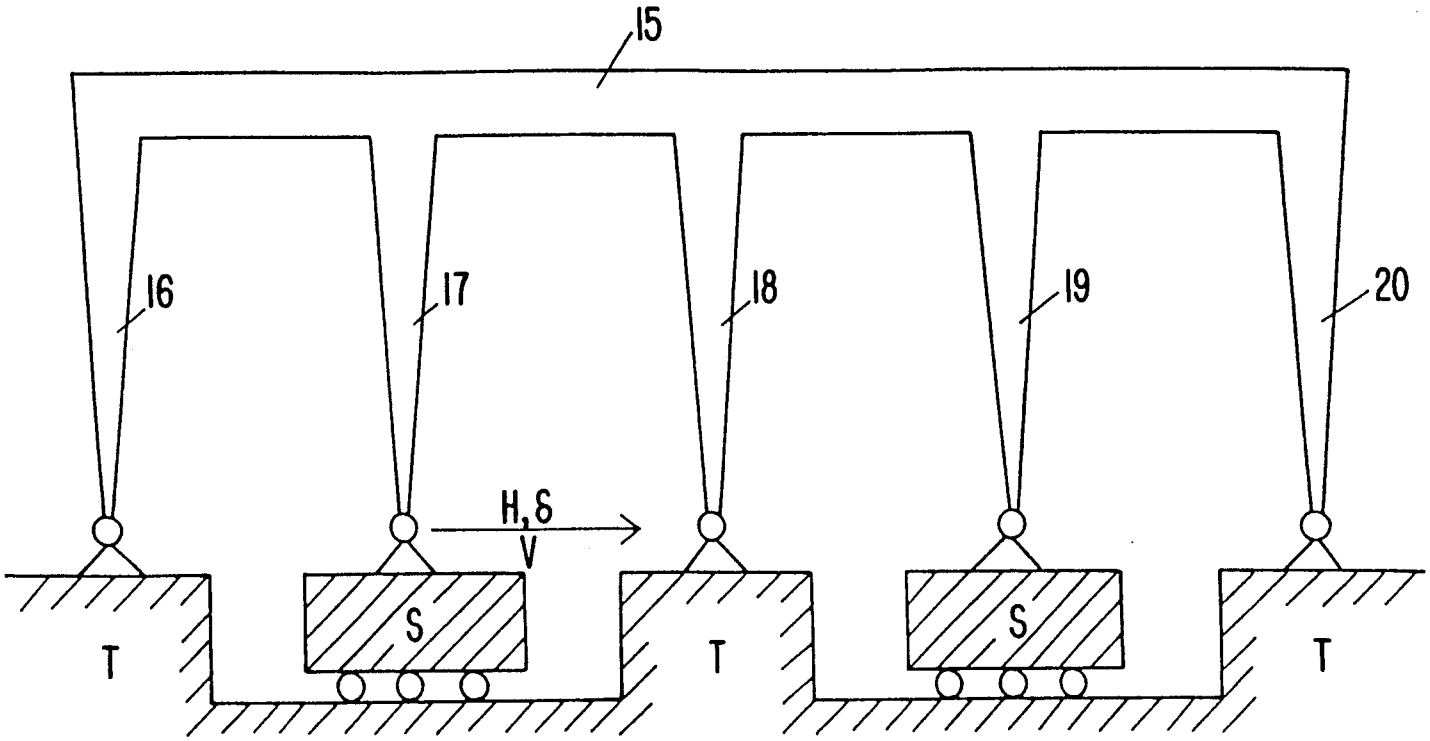
FIG. 4 is a diagrammatic view of the energy dissipating device in the form of a multiple portal according to the present invention.

In FIG. 4 there is shown an energy dissipating device in the form of a multiple portal, which is formed by the combination of two double portals comprising a girder 15 supported by five piers 16, 17, 18, 19 and 20. Each of the piers is arranged along a vertical axis and the piers are rigidly connected to the girder. The piers 16, 17 and 20 are intended to be fastened, through a hinge arranged at the free ends thereof, to the portion T of the structure, whereas the intermediate piers 17, 19 are intended to be fastened, again through hinges arranged at the free ends thereof, to the other portion S of the structure.

In FIG. 5 there is shown another type of energy dissipating device in which the side piers 11 and 13, rather than being vertical, are inclined.

From the foregoing it is apparent that the energy dissipating device according to the present invention exhibits the following advantages:

a marked hysteretic behavior of elasto-plastic type which is maintained without important decays after a suitable number of cycles, a high dissipative efficiency corresponding to the area of each loop, under the same transmitted maximum forces, the possibility of being charged after it has supported the attacks of a particularly severe earthquake, and "integral protection" of the structure even if the structure is subjected to a particularly violent earthquake because these dissipative devices have a marked elasto-plastic behavior, that is they have a practically constant plasticization threshold.

What is claimed is:

1. An energy dissipating device in a structure for dissipating energy imparted to the structure by the effects of seismic occurrences, said device comprising a side pier disposed to one side of the device and having a first end and a second end, the first end of said side pier being fastened to one portion of said structure; another side pier disposed to the other side of the device and having a first end and a second end, the first end of said another side pier being fastened to another one portion of said structure; at least one third pier extending between said side piers and arranged symmetrically thereof, each said at least one third pier having a first end and a second end, and said at least one third pier including a pier which has the first end thereof fastened to a third portion of said structure which is movable relative to said one portions of the structure under the effects of a seismic occurrence; and a girder spanning said side piers and rigidly connected with said at least one third pier and with said side piers at the second ends of said piers, respectively; said piers and said girder all being of a metal having high ductility wherein said piers and said girder together constitute an integral metal element which is asymmetrically deformable in the elastic field or beyond the elastic limit, whereby when said one portions of the structure are moved relative to said third portion of the structure during a seismic occurrence, said metal element is deformed in the elasto-plastic region and the energy of the seismic occurrence required to deform said metal element is dissipated by hysterisis of the metal principally in the form of heat.

2. A device as claimed in claim 1, wherein said girder extends horizontally, and said side piers extend longitudinally vertically or in a longitudinal direction inclined from the vertical, and said at least one third pier consists of a central pier extending intermediate of said side piers.

3. A device as claimed in claim 1, wherein said at least one third pier includes a plurality of piers.

4. A device as claimed in claim 3, wherein said at least one third pier consists of two intermediate piers, and a central pier extending between said intermediate piers, said central pier having the first end thereof fastened to still another one portion of said structure and said intermediate piers having the first ends thereof fastened to respective third portions of the structure.

* * * * *